US005267822A

United States Patent [19]

Paravia et al.

[11] Patent Number: 5,267,822

[45] Date of Patent: Dec. 7, 1993

[54] AUTOMATIC AUTOMOBILE PARKING GARAGE

[75] Inventors: Mario Paravia, Salerno; Luigi F. Von Mahlem, Milan, both of Italy

[73] Assignee: Paravia Ascensori, Salerno, Italy

[21] Appl. No.: 944,010

[22] Filed: Sep. 11, 1992

Related U.S. Application Data

[63] Continuation of Ser. No. 647,011, Jan. 29, 1991, abandoned.

[30] Foreign Application Priority Data

| | | | |
|---|---|---|---|
| Jan. 31, 1990 | [IT] | Italy | 5113 A/90 |
| Feb. 20, 1990 | [IT] | Italy | 5118 A/90 |
| Oct. 2, 1990 | [IT] | Italy | 5213 A/90 |

[51] Int. Cl.[5] ..... E04H 6/22

[52] U.S. Cl. ..... 414/239; 414/234; 414/264; 414/227; 414/255; 414/280; 414/260; 52/174

[58] Field of Search ..... 414/228, 227, 231, 241, 414/233, 234, 244, 245, 246, 252, 253, 255, 256, 259, 260, 261, 262, 264, 280, 661; 52/174

[56] References Cited

U.S. PATENT DOCUMENTS

| | | | |
|---|---|---|---|
| 2,285,232 | 6/1942 | Sheehan | 414/264 |
| 2,569,393 | 9/1951 | Walker | 414/234 |
| 2,598,750 | 6/1952 | Bargehr | 414/262 X |
| 2,726,774 | 12/1955 | Newsom et al. | 414/264 X |
| 2,816,624 | 12/1957 | Asheim et al. | 414/255 X |
| 3,680,718 | 8/1972 | Miyachi | 414/239 |
| 3,750,804 | 8/1973 | Lemelson | 414/280 X |
| 4,747,242 | 5/1988 | Aarstad | 414/227 X |
| 4,778,324 | 10/1988 | Sawyer | 414/252 X |
| 4,936,730 | 6/1990 | Morioka | 414/239 |
| 5,018,926 | 5/1991 | Sternad | 414/239 X |

FOREIGN PATENT DOCUMENTS

| | | | |
|---|---|---|---|
| 1243105 | 6/1967 | Fed. Rep. of Germany | 414/259 |
| 524552 | 4/1955 | Italy | 414/259 |
| WO89/11013 | 11/1989 | PCT Int'l Appl. . | |

*Primary Examiner*—Frank E. Werner

*Attorney, Agent, or Firm*—Mason, Fenwick & Lawrence

[57] ABSTRACT

An automatic automobile parking garage is provided, particularly an underground parking garage having an entrance at ground level, which is the location of the roof of the parking garage. One or two vertical arrays of automobile loading stations are provided, and at the roof, there is an automobile loading station. An elevator carries a pallet, and means for pushing the pallet laterally onto an automobile loading station, and then pulling the pallet, with the car on it, from the elevator base, the elevator base then being lowered until it is opposite an automobile storage station, where the pallet with the automobile on it is pushed laterally by pushing apparatus onto the automobile storage station. The automobile storage station comprises a pair of parallel, horizontal cantilever support beams, which support a pallet and an automobile thereon. A hatch is provided which is of a size and shape to cover, or close, the opening. The hatch is mounted on columns, which raise the hatch when an elevator base approaches the level of the automobile loading station, and which is lowered to cover or close the opening when the elevator base descends away from the automobile loading station.

11 Claims, 8 Drawing Sheets

AUTOMATIC AUTOMOBILE PARKING GARAGE

This application is a continuation of application Ser. No. 07/647,011 filed Jan. 29, 1991, now abandoned.

FIELD OF THE INVENTION

The present invention is directed to an automatic automobile parking garage for parking automobiles, without human assistance, in a parking garage structure.

BACKGROUND OF THE INVENTION

Parking garages having elevators for transporting automobiles to different levels, and apparatus for then removing the automobiles from the elevators, to place the automobile at a storage station at the parking level, are well known. Various arrangements have been provided, with typical arrangements providing for parking garages which extend above ground level and with the entrance at ground level. Other constructional arrangements have been provided including underground parking garages of this general nature.

The parking garages which have heretofore been provided have generally included a floor on which the automobile or a pallet supporting the automobile is supported while the automobile is in storage.

It is also known to provide a parking or storage apparatus in which an elevator having a roof may be raised to ground level to receive an automobile or other article, after which the elevator is lowered into a pit below ground level, the roof covering the pit. The platform or elevator base which carries the automobile or other article has only two positions: a lower position in a pit or an upper position in which the elevator base is substantially at ground level.

SUMMARY OF THE INVENTION

An automatic automobile parking garage is provided, particularly for construction as an underground parking garage with some or all of the automobile storage stations located beneath the level at which an automobile is driven to the garage and is loaded onto a movable elevator base, the automobile being moved laterally on a pallet which is positioned on an elevator base which is at substantially the same level as the automobile loading station. The elevator base, with the automobile thereon, is then lowered until it is at the level of an automobile storage station, the automobile storage station being one of a vertical array of automobile storage stations which are located preferably beneath the automobile loading station. The pallet with the automobile thereon is then moved horizontally from the elevator base, then being located on and supported by the automobile storage station. The automobile storage station is provided by at least one, and preferably two, cantilevered beams extending horizontally from a wall of the garage: where two or more such beams are used, they are parallel and the pallet has bushings which receive the beam or beams.

Adjacent the automobile loading station is an opening, the opening extending vertically from the level of the automobile loading station and being adjacent the array of automobile storage stations. There may be a single loading station adjacent the opening, or a pair of automobile loading stations preferably at the same level and on either side of the opening. Similarly, there is preferably provided two vertical arrays of automobile storage stations, each array being adjacent to and on opposite sides of the vertically extending opening for the elevator base, so that automobiles may be moved to automobile storage stations in either of the arrays of stations, from the elevator base, and returned from the storage stations in either array onto the elevator base, for subsequent vertical movement on the elevator base from the automobile loading station.

Above the opening, there is provide a vertically movable hatch. The hatch is of a size and shape to cover and close the opening, and may be moved to an upper position in which it is above the level of the automobile loading station a sufficient distance to enable an automobile on a pallet supported on the elevator base to be beneath it. When an automobile is not being delivered to or from the unloading station, the hatch is moved to a lower position in which it covers the opening, to prevent a person from falling into the opening. Suitable railings are provided on the pallet, and recesses for the automobile wheels are provided on the upper surface of the pallet, the arrangement being such that the railing is close to one side of the automobile, thereby preventing the opening of the doors o that side of the automobile: this requires, therefore, that all occupants of the automobile enter and leave it on the side opposite the railings, which, in connection with other architectural features, is the safe point of entry into and departure from the automobile.

DESCRIPTION OF THE PREFERRED EMBODIMENTS

Figure 1:
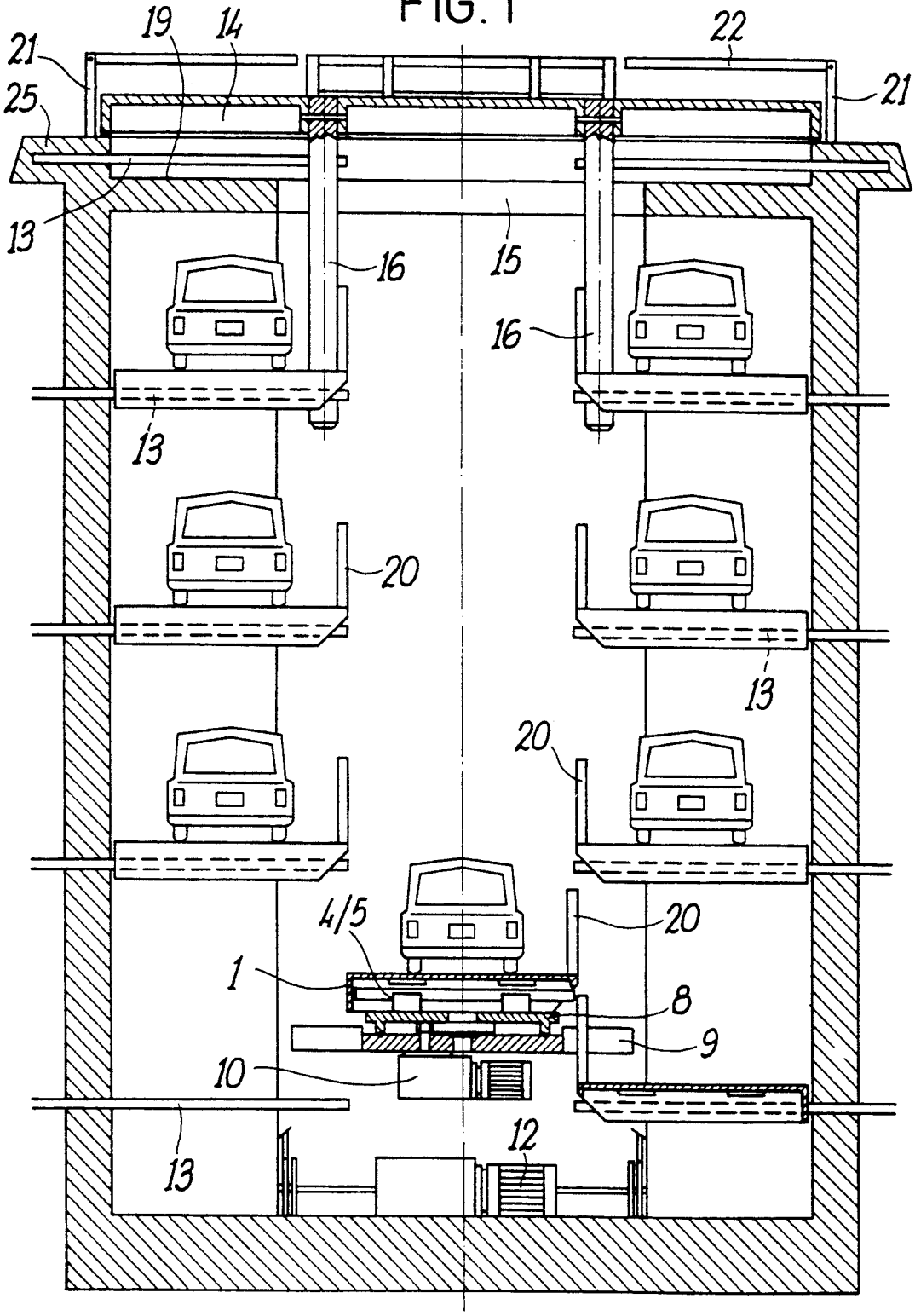
FIG. 1 is a vertical cross-sectional view of an automatic automobile parking garage in accordance with the present invention.

Referring to the drawings, wherein like or corresponding numerals are used to designate like or corresponding parts throughout the several views, there is shown in FIG. 1 an automatic automobile parking garage in accordance with the present invention, the structure including a pallet 1 which is preferably supported on a platform 8. An automobile is shown in position on the pallet 1. The platform 8 is rotatably supported on an elevator base 9, being mounted for rotation on a vertical axis. Rotation of the platform 8 is effected by a motor 10 carried by elevator base 9.

The structure of the garage includes a roof 19 having an opening 15 therein which is preferably rectangular, and is above the elevator base 9.

Figure 3:
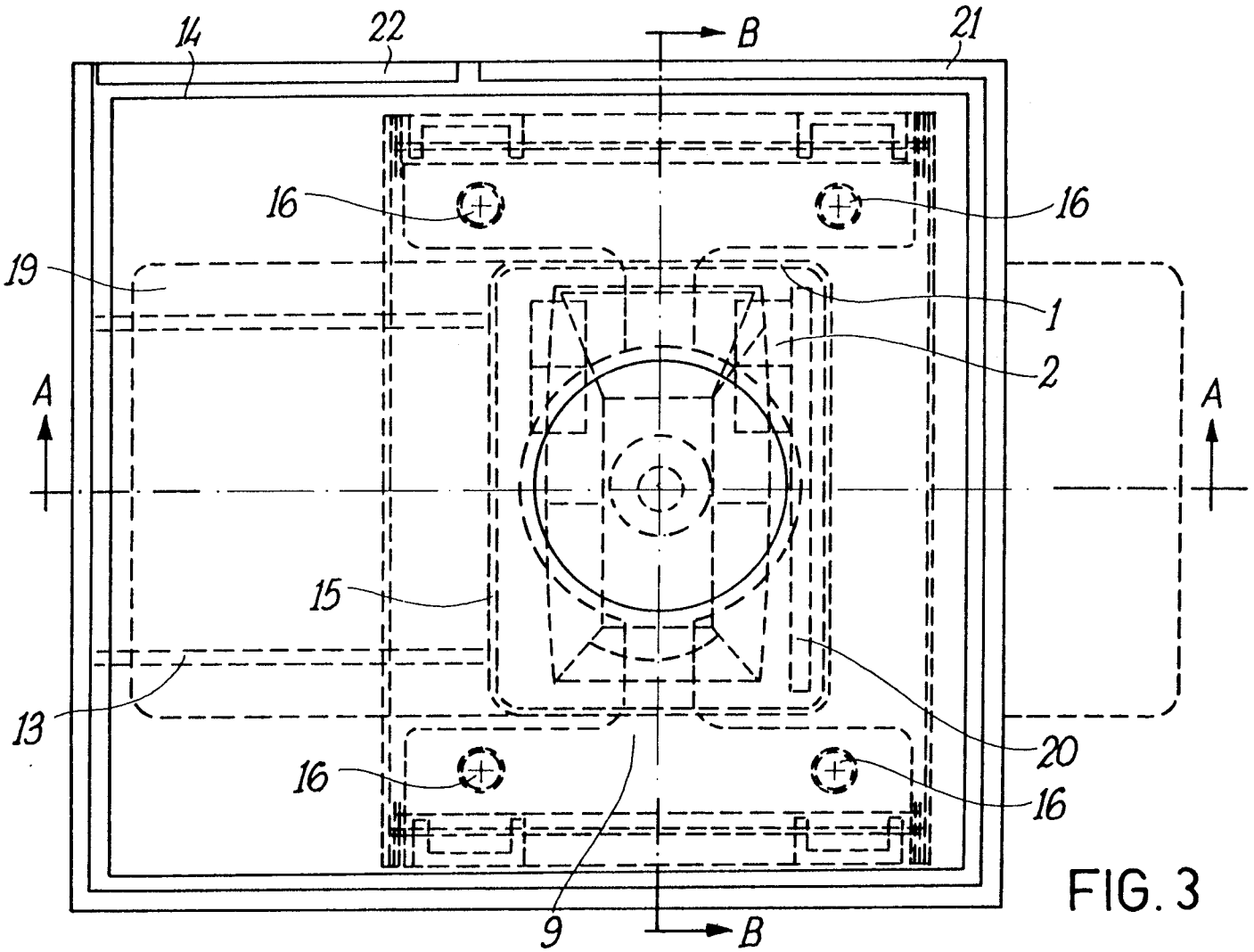
FIG. 3 is a plan view of an embodiment of an automatic automobile parking garage in accordance with the present invention in which there is a single automobile loading station.
Figure 4:
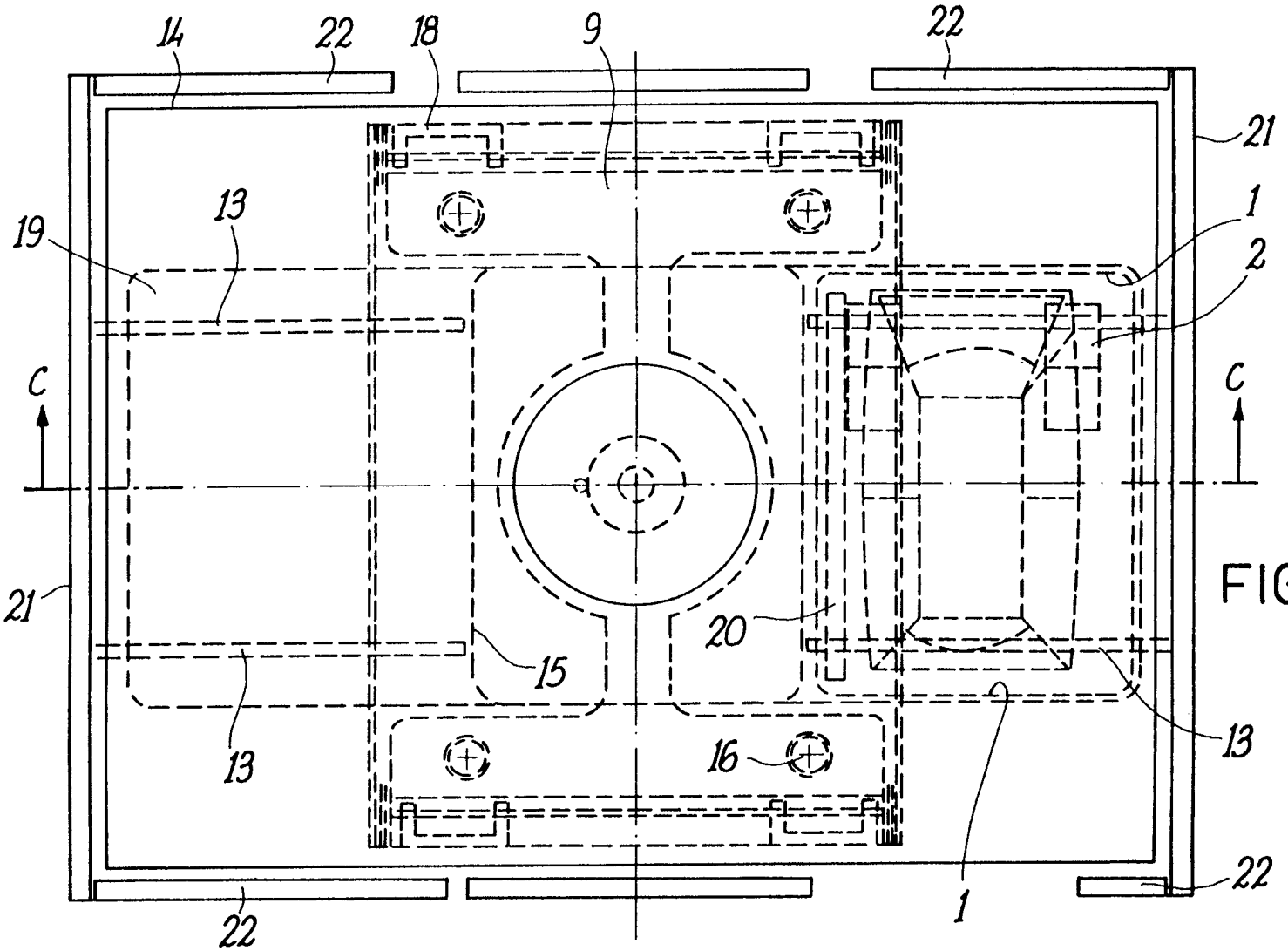
FIG. 4 is a view similar to FIG. 3, of an alternate embodiment of the present invention in which there are two vertical arrays of automobile storage stations and two automobile loading stations.

Beneath the opening 15 is a vertically extending opening, and on either side thereof there is a vertical array of automobile storage stations, each of which is provided by a pair of horizontal cantilevered beams 13, which are parallel, as shown in FIGS. 3 and 4. The topmost beams 13, shown above the roof 19, provide an automobile loading station, these beams 13 supporting a pallet in position thereon to receive an automobile, or to deliver an automobile so that it may be driven away from the automobile loading station.

Above the opening 15 is a hatch 14. Hatch 14 is of a size and shape, as shown in FIGS. 1 and 4, to extend over and cover and close the opening 15, and in addition, to extend over the two automobile loading stations provided by the uppermost pairs of beams 13.

Figure 2:
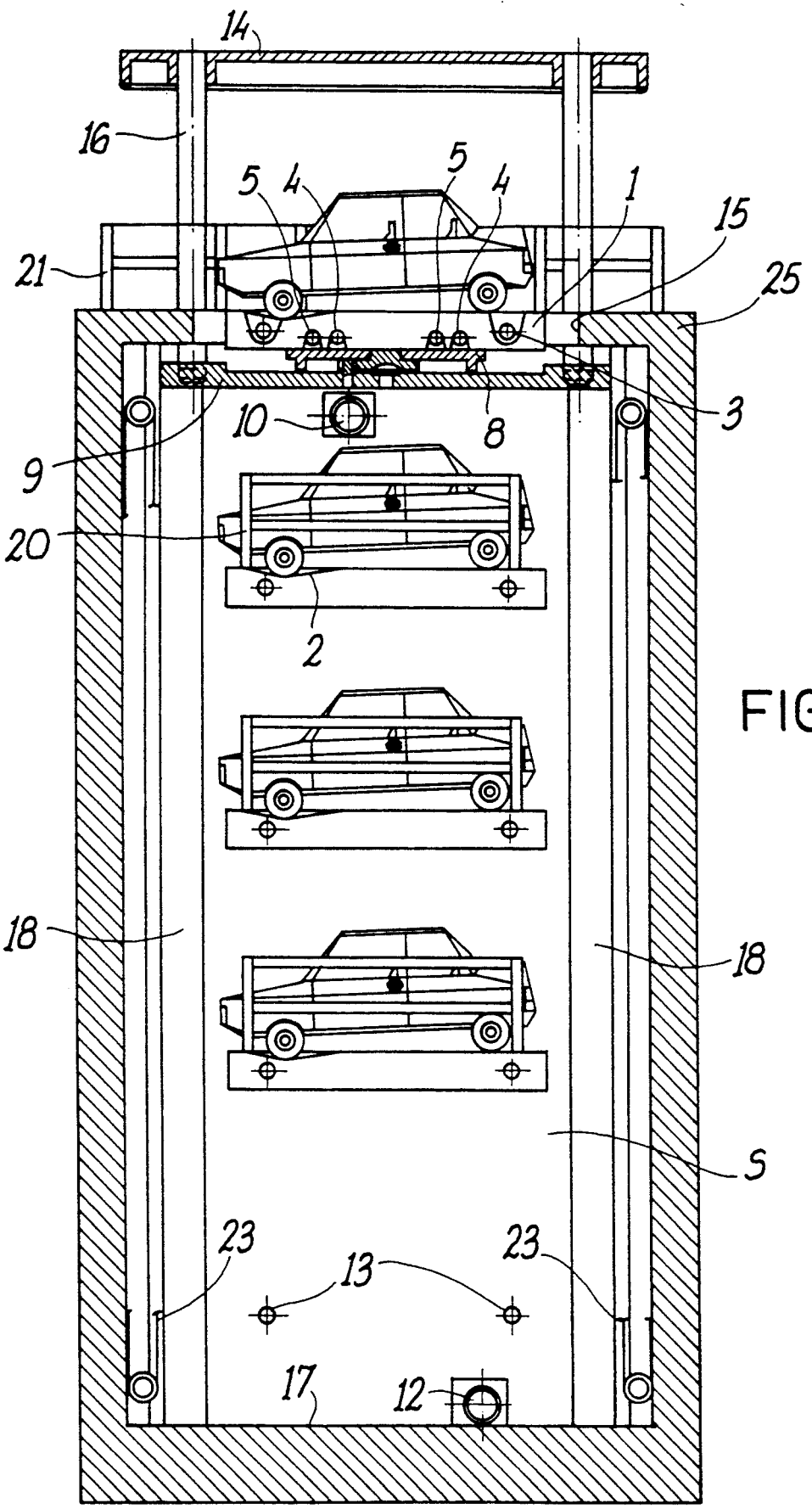
FIG. 2 is a vertical cross-sectional view of the automatic automobile parking garage, taken on the line 2—2 of FIG. 3.

In FIG. 2, there may be seen one array of automobile storage stations, with automobiles at the three uppermost storage stations, the lower storage station, provided by the two lower beams 13, not having an automobile. At the upper part of the garage, it will be seen that the elevator base 9 is at an upper level, supporting the pallet 1 so that it may be moved laterally, with bushings 3 forming a part of pallet 1 embracing the cantilever beams at the automobile loading station. The hatch 14, which is supported on columns 16, is located above the opening 15, and is at an elevation substantially above the automobile supported on the pallet 1. Vertically extending guides 18, which are in the form of channels, as shown in FIG. 4, cooperate with the elevator base 9 to guide it vertically. Elevator base 9 is raised and lowered by suitable apparatus, such as chains 23 driven by the motor 12. As will be appreciated, the elevating apparatus for elevator base 9 may be provided by alternate apparatus, such as a hydraulic piston or other apparatus. The lower ends of the columns 16 are seated in recesses in the elevator base 9: as will be understood, when the elevator base is lowered, hatch 14 will descend, to its lower position as shown in FIG. 1, and when elevator base 9 is raised it will engage the lower ends of columns 16 to raise hatch 14. There may be seen in the upper surface of each of the pallets 1 a groove 2, which aids in positioning the wheels of an automobile, and in placing the automobile in the desired position on the pallet 1.

Referring now to FIG. 3, there may be seen an embodiment of the invention, in plan view, in which there is only a single vertical array of automobile storage stations. The columns 16 will be seen to extend through bushings 17, which are located in the roof 19.

FIG. 4 is a plan view of an embodiment of the invention as shown in FIG. 1, and is similar to FIG. 3, there being two automobile loading stations. There may be seen the hatch 14, the opening 15, and a pallet 1 located at the right hand automobile loading station. Also shown in FIG. 4 are railings 21 which extend upwardly above the upper level of the garage (see also FIGS. 1 and 2) for purposes of safety: the railing 21 includes a pivoted arm 22 permitting passage of an automobile to and from a pallet 1 when the pallet 1 is positioned at one or the other of the automobile loading stations.

Figure 5:
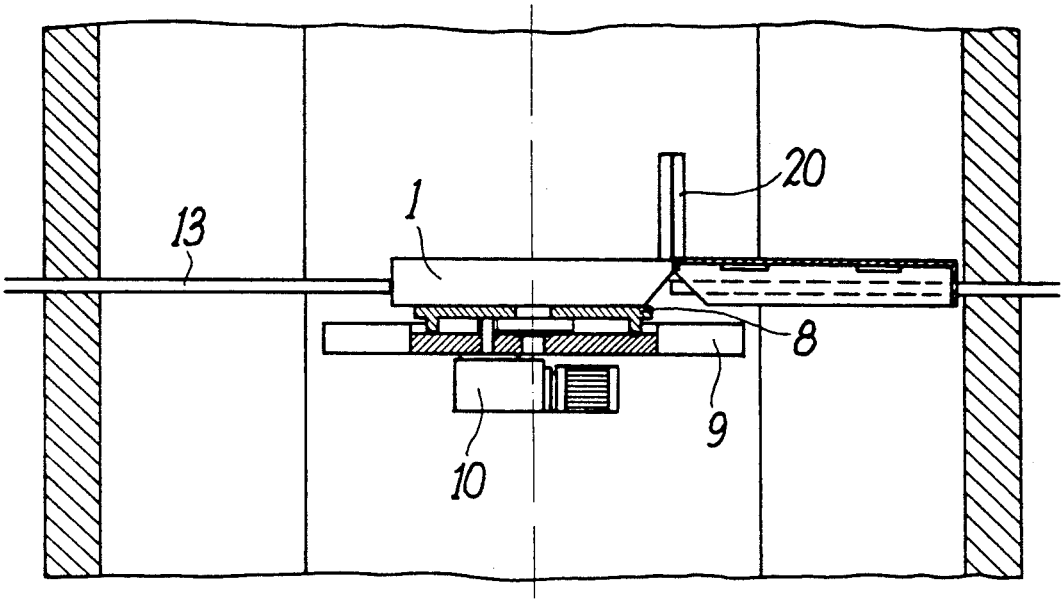
FIG. 5 is a cross-sectional view taken on the line 5—5 of FIG. 4, showing a pair of opposed automobile storage stations, and an elevator base and pallet thereon.

FIG. 5 is a view showing the elevator base 9 at a level in which the pallet 1 is in alignment with beams 13 at one of the automobile loading stations in the left hand array of automobile loading stations. In the opposed right hand automobile loading station at this level, a pallet 1 will be seen supported on the beams 13 which provide the supporting structure of the right hand automobile loading station.

Figure 6:
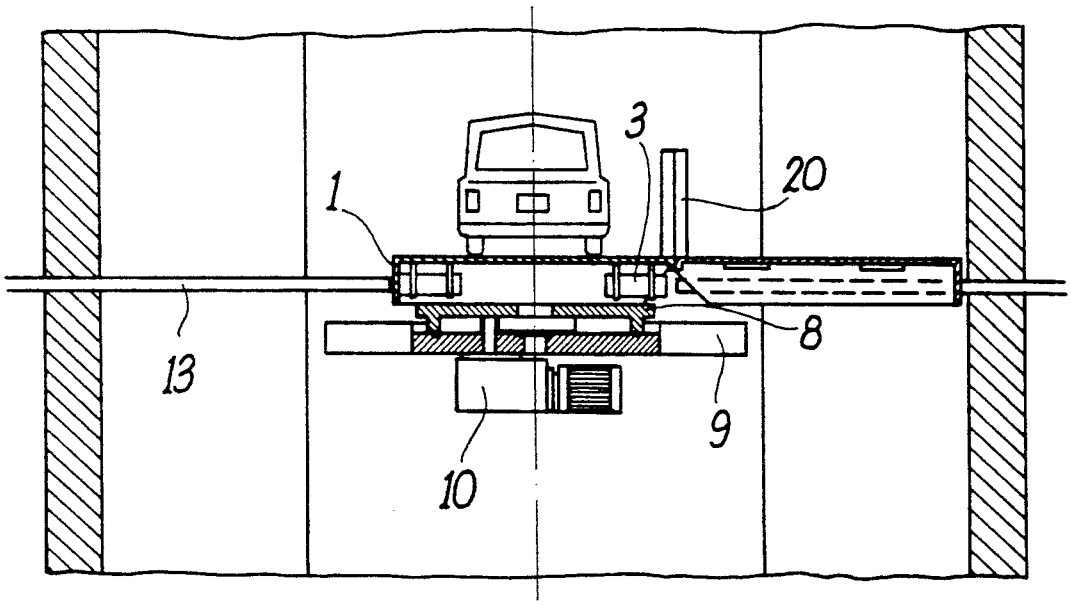
FIG. 6 is a view similar to FIG. 5, showing an automobile supported on a pallet which has been removed from an automobile storage station in the left hand array of automobile storage stations.

FIG. 6 provides a disclosure of the same structure as in FIG. 5, the pallet 1 carried by the platform 8 and elevator base 9 being in cross-section, showing the bushings 3 thereof in alignment with the beams 13. An automobile is shown on the pallet 1 supported by elevator base 9, and the pallet 1 with the automobile thereon is in position, after the pallet 1 has been removed from the left hand automobile storage station, in preparation for raising the elevator base 9 and the car thereon; alternatively, the pallet 1 with the automobile thereon and supported by elevator base 9 is in position for delivery to the left hand automobile storage station.

Figure 7:
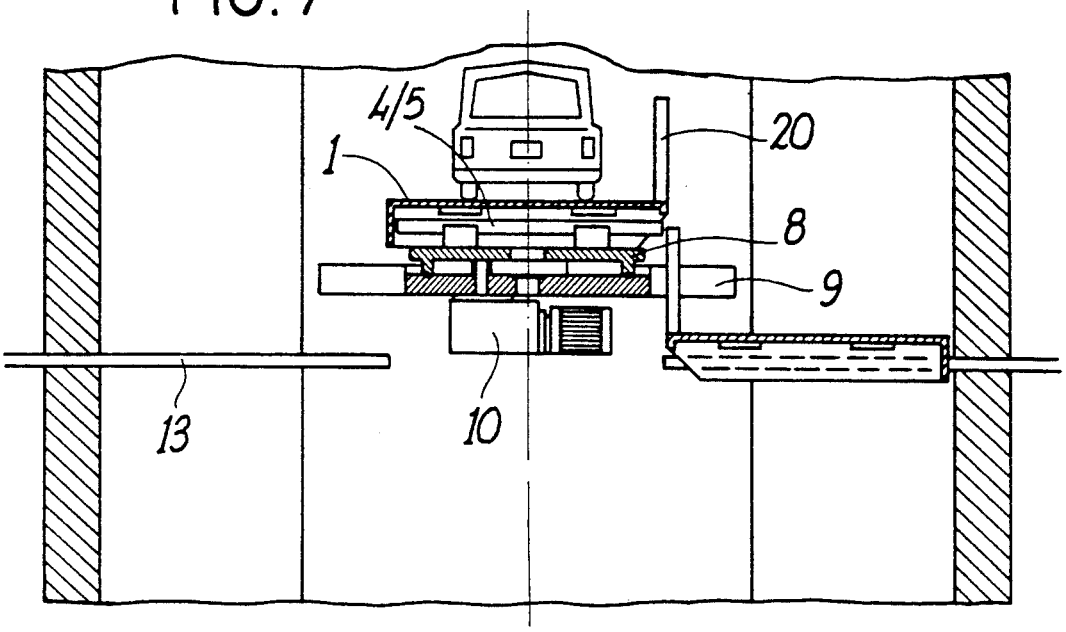
FIG. 7 is similar to FIG. 6, showing the elevator base and automobile supported on it at a level above the automobile storage stations shown in FIG. 6.

FIG. 7 is a view similar to FIG. 6, but showing the elevator base 9 raised somewhat with the automobile thereon. It is above the level of the previously noted left hand and right hand automobile storage stations, and the right hand automobile storage station will be seen to have a pallet 1 stored on it. The shape of the elevator base 9 will be seen, from FIGS. 3 and 4, to be such that elevator base 9 may pass by the automobile storage stations without striking either a pallet 1 or an automobile thereon.

Figure 8:
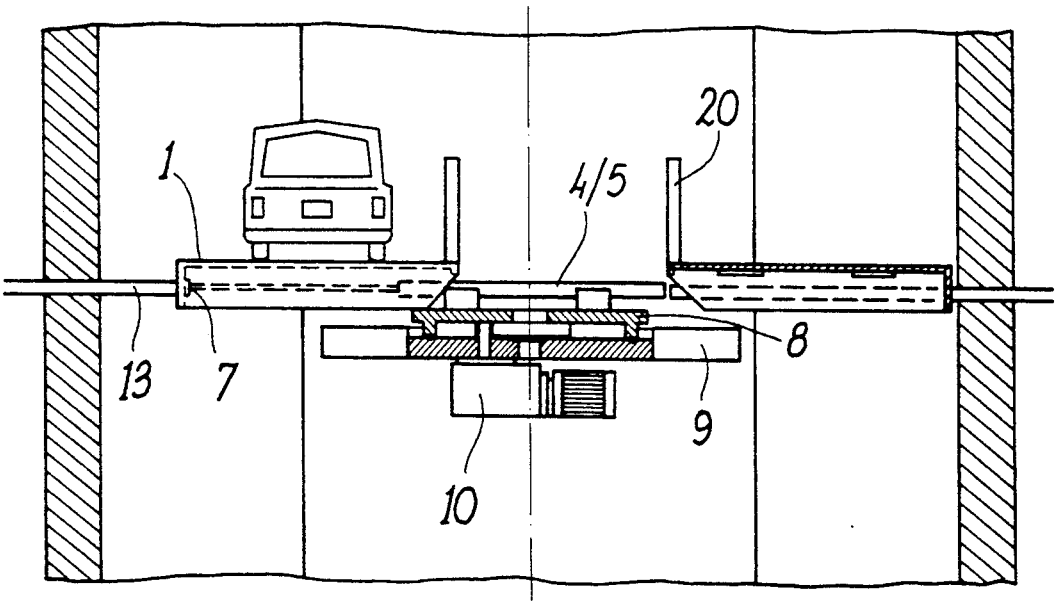
FIG. 8 is a view similar to FIG. 7, showing a pallet supporting an automobile and being supported partly at the left hand automobile storage station.

In FIG. 8, there is shown mounted on the platform 8 a pair of hydraulic cylinder 4 and 5 which extend parallel to the beams 13. The piston of one or the other of the hydraulic cylinders 4, 5 will be seen to have been extended to the left, pushing the pallet 1 to the left so that it is on and supported by the cantilevered beams 13. The pallet 1 is shown in an intermediate position, and is being pushed by the engaging means 7 at the end of the piston of the hydraulic cylinder 4, 5. Where a pallet 1, with or without an automobile thereon, is to be removed from the beams provided at the automobile storage station, the hydraulic cylinder 4, 5 is actuated, causing the engaging means 7 to engage the pallet 1, after which the hydraulic cylinder 4, 5 is retracted, to pull the pallet 1 from the automobile storage station onto the platform 8 and elevator base 9. The engaging means 7 may be an electromagnet, or may be a suitable latching or grappling means which is capable of pushing and pulling the pallet 1 and releasing it when appropriate.

As will be appreciated, one or one set of hydraulic cylinders 4 will be used to move a pallet 1 between the elevator base 9 and the left hand automobile storage stations, and one or one set of hydraulic cylinders 5 will be used to move a pallet 1 to and from the right hand automobile storage stations.

Figure 9:
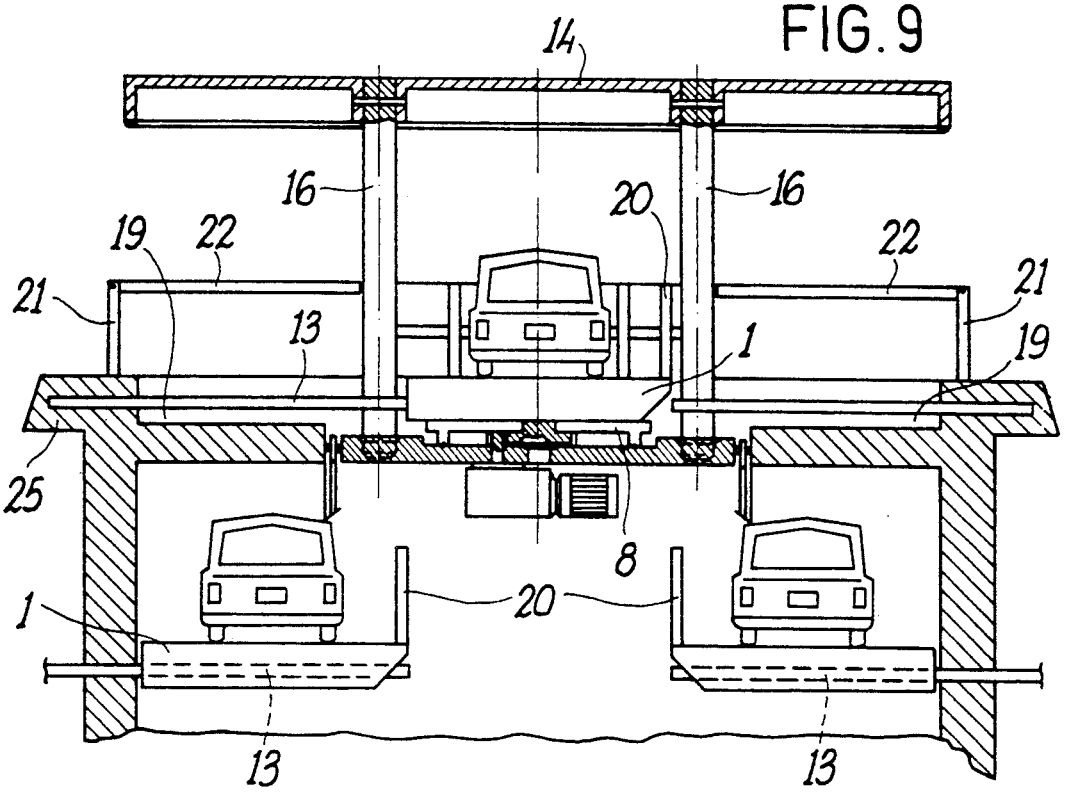
FIG. 9 is a view similar to the upper part of FIG. 1, but showing the elevator base and automobile thereon at the level of a loading station, and with a hatch in raised position.

In FIG. 9, there is shown the upper portion of the automatic automobile parking garage in accordance with the present invention, there being pallets 1 with automobiles thereon in the uppermost automobile storage stations in the left hand and right hand arrays of automobile storage stations. The elevator base 9 has moved to its uppermost position, supporting a pallet 1 with an automobile thereon. The raising of the elevator base 9 has caused the lower ends of columns 16 to be engaged, to raise the hatch 14.

Figure 10:
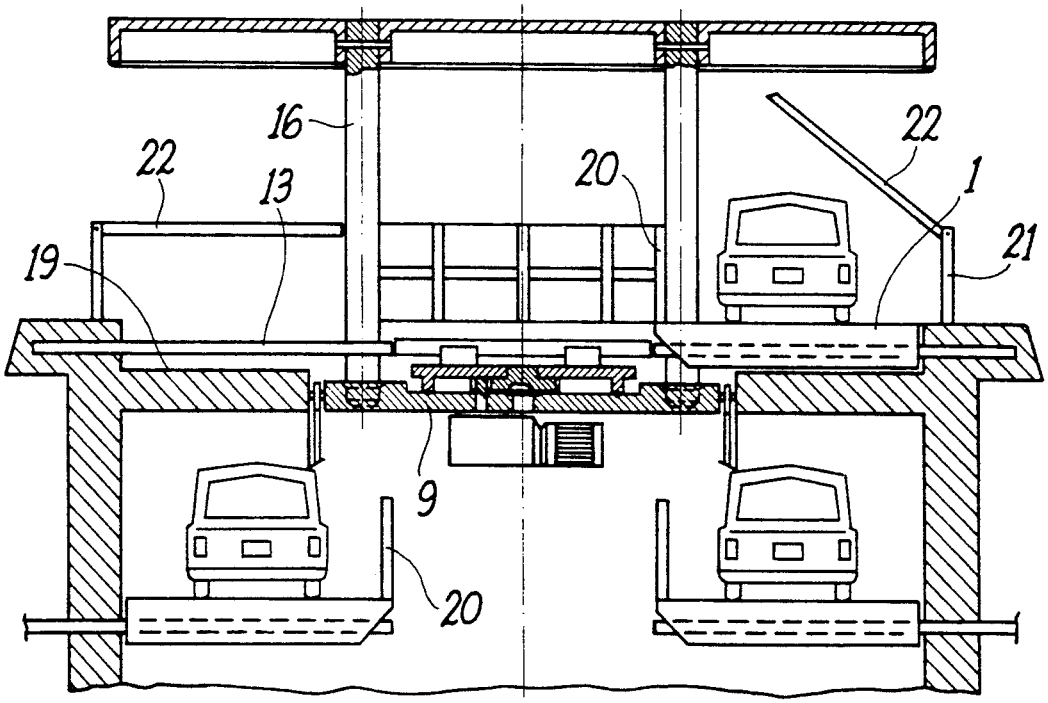
FIG. 10 is a view similar to FIG. 9, and showing a pallet with an automobile thereon at the automobile loading station.

Referring to FIG. 10, the hydraulic cylinder 4, 5 has been actuated to move the pallet 1 to the right hand automobile loading station, the driver and passengers if any having entered the automobile, and the hinged or pivoted bar 22 has been raised to permit departure of the automobile.

The above mentioned recesses or grooves 2 on the pallet 1 are positioned so that when an automobile is driven onto pallet 1, at least the front wheels enter the grooves or recesses 2. The grooves or recesses 2 are so positioned laterally of the automobile that one side of the automobile is closely adjacent railing 20 which extends upwardly from the pallet 1, so that the railing 20 prevents the opening of the door or doors on one side of the automobile when so positioned. This forces the people to enter and leave the automobile only through the doors on the other side, so that they approach and leave the automobile only from a location which is safe. Thus, it is not possible to open the doors of the automobile on the side which is adjacent the opening 15.

Figure 11:
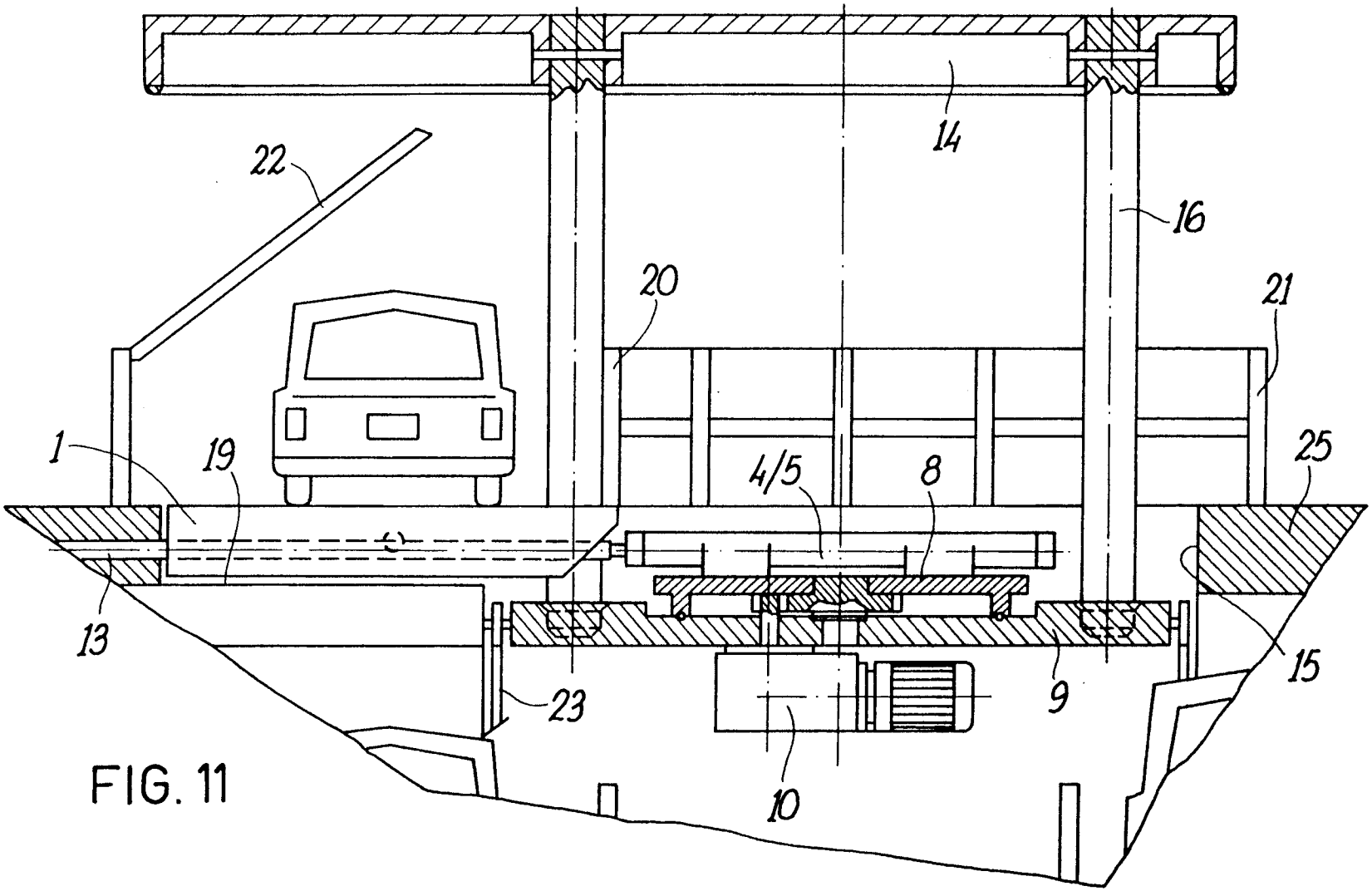
FIG. 11 is a cross-sectional view of the embodiment of FIG. 3, wherein an automobile is supported on a platform at the single automobile loading station, and with the hatch in open position.

In FIG. 11, which is a view of the embodiment shown in FIG. 3, having only a single automobile loading station, the elevator base 9 and hatch 14 are in the same position as in FIGS. 9 and 10, and the hydraulic cylinder 4, 5 has been actuated to move the pallet 1 to the left, with the automobile thereon, this being the single automobile loading station in this embodiment of the invention.

There has been provided an automatic automobile parking garage which is extremely safe to use, with structure to prevent accidents to automobile drivers and others, including security against falling into an opening of the garage.

In addition there has been provided such a garage in which a unique, low cost but strong structure is provided for supporting automobiles at automobile storage stations.

In addition, the present invention automatic automobile parking garage includes provision for not only raising and lowering an automobile to and from automobile storage stations and one or more automobile loading stations, but also provides for rotational movement of a pallet and an automobile supported thereon to enable the automobile to be in alignment with an access road which may not be in preferred direction, and which also enables an automobile to be delivered to a automobile loading station with its front end in a direction which will not require the driver to back away from the garage. Thereby, where there is only a single ingress and egress roadway, an automobile may drive to the garage in the forward direction, be transferred to an automobile storage station, and then be retrieved and delivered to the automobile loading station while it is on the elevator base.

There has been provided, further, a construction which will enable an automatic automobile parking garage to be operated without attendants. By a suitably encoded card or key, a person approaching the garage can set in operation a circuitry which will cause the elevator base to rise, and enable the driver to drive onto the pallet and then leave his automobile, after which in a substantially automatic manner, the automobile will be transferred to an automobile storage station. To retrieve the automobile, the encoded magnetic card may be used for the reverse operating procedure. The elevator base will be caused to remain in a lower position, thereby placing the hatch in a position covering and closing the entrance into the opening into the garage, and movable railing elements can be caused to move in an automatic manner.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

We claim:

1. An automatic automobile parking garage comprising:

a multi-story garage structure having a first array of vertically spaced automobile storage stations therein, each said automobile storage station comprising means for supporting an automobile, said means comprising at least one substantially horizontal beam, elevator means for raising and lowering an elevator base, a pallet on said elevator base, means for mounting said pallet for movement laterally of said elevator base, means on said elevator base for pushing a pallet off said elevator base onto a said beam, and for pulling a pallet off said beam onto said elevator base, a pair of horizontally spaced automobile loading stations, each automobile loading station comprising at least one horizontal beam for receiving and supporting said pallet, an opening between said automobile loading stations, said opening extending vertically downwardly from said automobile loading station, and said elevator base being in said vertically extending opening, and a hatch of size and shape to extend at least over said opening and having a means for raising and lowering said hatch including a plurality of columns extending downwardly from said hatch and having bottoms and means on said elevator base for engaging the bottoms of said columns when said elevator base reaches a predetermined position near a top of the garage, wherein said hatch is lowered to cover said opening and raised to enable an automobile on a said pallet to be loaded or unloaded between either of said pair of loading stations and said elevator base.

2. The automatic automobile parking garage as claimed in claim 1, and further comprising:

a platform, means for supporting said platform on said elevator base for rotation thereon about a vertical axis, means on said platform to support said pallet for horizontal movement, said means for pushing and pulling said pallet being on said platform.

3. The automatic automobile parking garage as claimed in claim 2, and further comprising:

means on said elevator base for rotating said platform.

4. The automatic automobile parking garage as claimed in claim 2, wherein said means for pushing and pulling said pallet comprise cylinders, and means carried thereby for engaging a said pallet for pushing and pulling said pallet.

5. The automatic automobile parking garage as claimed in claim 4, wherein said engaging means comprises an electromagnet.

6. The automatic automobile parking garage as claimed in claim 2, wherein said pallet comprises at least one bushing for engaging each said horizontal beam at each said automobile storage station.

7. The automatic automobile parking garage as claimed in claim 2, said pallet comprising means for preventing the opening of a door or doors on one side of an automobile on said pallet, protective railings extending upwardly therefrom, and recesses in said pallet for positioning said an automobile with one side thereof closely adjacent a said railing.

8. The automatic automobile parking garage as claimed in claim 7, and further comprising railings, including movable bars, on said garage adjacent said automobile loading station.

9. The automatic automobile parking garage as claimed in claim 1, wherein:

said garage comprises a second array of vertically spaced storage stations each of which is opposite and at the same level as a storage station of said first array of storage stations, said first and second mentioned storage station arrays having a space therebetween for receiving said elevator base, said means for pushing and pulling said pallet comprising means for selectively pushing a pallet onto a storage station in the first mentioned array of storage stations, or onto a storage station of the second mentioned array of storage stations.

10. The automatic automobile parking garage as claimed in claim 1, wherein said garage extends underground, said automobile loading stations located at the upper level thereof.

11. The automatic automobile parking garage as claimed in claim 1, wherein said opening is rectangular, and wherein each said automobile loading station is adjacent a long side of said rectangular opening.

* * * * *